US011686076B1

(12) United States Patent
Peng et al.

(10) Patent No.: US 11,686,076 B1
(45) Date of Patent: Jun. 27, 2023

(54) THERMOSTATIC AUTOMATIC FAUCET

(71) Applicant: Harda Intelligent Technologies Co., Ltd., Fujian (CN)

(72) Inventors: Kesheng Peng, Xiamen (CN); Shengshen Zhan, Xiamen (CN); Zhiyi Lin, Xiamen (CN)

(73) Assignee: HARDA INTELLIGENT TECHNOLOGIES CO., LTD., Fujian (CN)

( * ) Notice: Subject to any disclaimer, the term of this patent is extended or adjusted under 35 U.S.C. 154(b) by 0 days.

(21) Appl. No.: 17/580,653

(22) Filed: Jan. 21, 2022

(51) Int. Cl.
*E03C 1/05* (2006.01)
*E03C 1/04* (2006.01)

(52) U.S. Cl.
CPC ..... *E03C 1/057* (2013.01); *E03C 1/0412* (2013.01); *E03C 2001/0418* (2013.01)

(58) Field of Classification Search
CPC ..... E03C 1/057
See application file for complete search history.

(56) References Cited

U.S. PATENT DOCUMENTS 5,549,273 A * 8/1996 Aharon ..... E03C 1/057 251/30.05
8,104,113 B2 * 1/2012 Rodenbeck ..... G01S 17/04 251/129.03
8,978,700 B2 * 3/2015 Frackowiak ..... F16K 11/0787 137/625.4
9,194,110 B2 * 11/2015 Frick ..... E03C 1/055

* cited by examiner

*Primary Examiner* — Michael R Reid
(74) *Attorney, Agent, or Firm* — Leong C. Lei

(57) ABSTRACT

A thermostatic automatic faucet includes a faucet body, a solenoid valve, a human body sensor unit, and a water mixing valve. The water mixing valve is installed in the faucet body. An inlet end of the solenoid valve is in communication with a water mixing outlet of the water mixing valve. An outlet end of the solenoid valve is in communication with a nozzle of the faucet body. The human body sensor unit controls the solenoid valve to be opened and closed. The faucet is controlled to spray water or not by a sensor, and the water temperature can be adjusted. The safety and durability of the product are improved.

7 Claims, 4 Drawing Sheets

THERMOSTATIC AUTOMATIC FAUCET

BACKGROUND OF THE INVENTION

1. Field of the Invention

The present invention relates to a faucet, and more particularly to a thermostatic automatic faucet.

2. Description of the Prior Art

A conventional automatic faucet is controlled to spray water or not through the cooperation of a human body sensor unit (such as an infrared human body sensor) and a solenoid valve. It is more hygienic and convenient to use. However, the conventional automatic faucet has limitations in use, that is, the user cannot adjust the water temperature independently, which affects the user experience. In addition, when the solenoid valve of the conventional automatic faucet is closed to shut off the water, the inlet end of the solenoid valve will always be affected by the water flow, that is, the solenoid valve will be in a state of high-pressure resistance. In this way, the solenoid valve with a complex structure is easily damaged in the state of being closed for a long time, which may cause the problem of water leakage. The durability is poor.

SUMMARY OF THE INVENTION

In view of the deficiencies of the prior art, the primary object of the present invention is to provide a thermostatic automatic faucet. The faucet is controlled to spray water or not by a sensor, and the water temperature can be adjusted. It is convenient for users to use. The safety and durability of the product are improved.

In order to achieve the above object, the present invention adopts the following technical solutions:

A thermostatic automatic faucet comprises a faucet body, a solenoid valve, a human body sensor unit, and a water mixing valve. The faucet body includes a main body, a spout connected to a side wall of the main body, and a nozzle disposed on the spout. The main body is in communication with the spout. The nozzle is located on an underside of the spout. The water mixing valve is installed in the faucet body. The water mixing valve has a cold water inlet, a hot water inlet, and a water mixing outlet. An inlet end of the solenoid valve is in communication with the water mixing outlet of the water mixing valve through a water mixing pipe. An outlet end of the solenoid valve is in communication with the nozzle through a delivery pipe. The water mixing pipe and the delivery pipe are inserted in the main body. The delivery pipe is further inserted in the spout and connected to the nozzle. The human body sensor unit is fitted to the faucet body. The human body sensor unit is electrically connected to the solenoid valve and controls the solenoid valve to be opened and closed.

Preferably, the water mixing valve includes a water mixing valve core and a water mixing valve seat. The water mixing valve core and the water mixing valve seat are sequentially installed in the main body. The water mixing valve seat has the cold water inlet, the hot water inlet, and the water mixing outlet. The water mixing valve core controls the cold water inlet and the hot water inlet to communicate with the water mixing outlet.

Preferably, an inner wall of the main body has a projecting rim. An outer wall of the water mixing valve seat has a valve seat rim abutting against an upper side of the projecting rim.

The mixing valve core is placed on top of the mixing valve seat. An upper opening of the main body is fitted with a valve cover. The valve cover is configured to press the water mixing valve core.

Preferably, the water mixing valve seat has a valve seat opening facing upward. The valve seat opening is in communication with the cold water inlet, the hot water inlet and the water mixing outlet. A lower end of the water mixing valve core is inserted into the valve seat opening.

Preferably, a lever of the water mixing valve core is connected to an operating handle.

Preferably, the human body sensor unit includes a first sensor. The first sensor is disposed on the nozzle. The first sensor is electrically connected to the solenoid valve.

Preferably, a sensing direction of the first sensor is along a water spray direction of the nozzle.

Preferably, the human body sensor unit further includes a second sensor. The second sensor is disposed on one side of the main body. A sensing direction of the second sensor is interlaced with a setting direction of the spout. The second sensor is electrically connected to the solenoid valve.

Alternatively, the human body sensor unit includes a sensor. The sensor is disposed on one side of the main body. A sensing direction of the sensor is in the same direction as a setting direction of the spout. The sensor is electrically connected to the solenoid valve.

Preferably, a cold water pipe and a hot water pipe are connected to the cold water inlet and the hot water inlet, respectively.

In the present invention, the nozzle is controlled to spray water or not through the cooperation of the human body sensor unit and the solenoid valve, so as to control the faucet of the present invention to spray water or not through a sensor. In the present invention, the temperature of the water flowing into the solenoid valve can be adjusted through the water mixing valve, so as to adjust the temperature of the water flowing out of the nozzle. Thus, the adjustment of the water temperature of the faucet provided by the present invention is realized, which is convenient for users to use. In addition, in the present invention, the water mixing valve can be closed to shut off the water flowing into the solenoid valve, so that the solenoid valve will not withstand pressure, thereby increasing the safety and durability of the product.

DETAILED DESCRIPTION OF THE PREFERRED EMBODIMENTS

Figure 1:
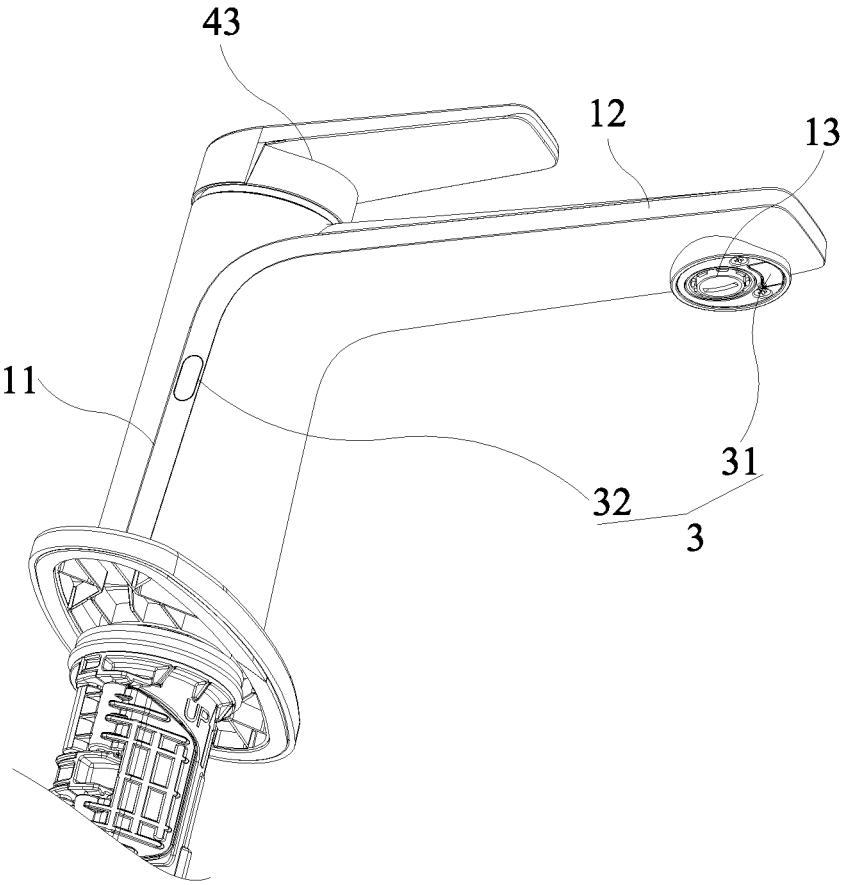
FIG. 1 is a partial perspective view according to a first embodiment of the present invention.

Embodiments of the present invention will now be described, by way of example only, with reference to the accompanying drawings.

As shown in FIG. 1 through FIG. 4, the present invention discloses a thermostatic automatic faucet, comprising a faucet body 1, a solenoid valve 2, a human body sensor unit 3, and a water mixing valve 4. The faucet body 1 includes a main body 11, a spout 12 connected to the side wall of the main body 11, and a nozzle 13 disposed on the spout 12. The main body 11 is in communication with the spout 12. The nozzle 13 is located on the underside of the spout 12. The water mixing valve 4 is installed in the faucet body 1. The water mixing valve 4 has a cold water inlet 401, a hot water inlet 402, and a water mixing outlet 403. A cold water pipe 5 and a hot water pipe 6 are respectively connected to the cold water inlet 401 and the hot water inlet 402 for introducing cold water and hot water into the water mixing valve 4. An inlet end of the solenoid valve 2 is in communication with the water mixing outlet 403 of the water mixing valve 4 through a water mixing pipe 7. An outlet end of the solenoid valve 2 is in communication with the nozzle 13 through a delivery pipe 8. Both the water mixing pipe 7 and the delivery pipe 8 are inserted in the main body 11. The delivery pipe 8 is further inserted in the spout 12 and is connected to the nozzle 13. The human body sensor unit 3 is fitted to the faucet body 1. The human body sensor unit 3 is electrically connected to the solenoid valve 2 and controls the solenoid valve 2 to be opened and closed.

In the present invention, the nozzle 13 is controlled to spray water or not through the cooperation of the human body sensor unit 3 and the solenoid valve 2, so as to control the faucet of the present invention to spray water or not through a sensor. In the present invention, the temperature of the water flowing into the solenoid valve 2 can be adjusted through the water mixing valve 4, so as to adjust the temperature of the water flowing out of the nozzle 13. Thus, the adjustment of the water temperature of the faucet provided by the present invention is realized, which is convenient for users to use. In addition, in the present invention, the water mixing valve 4 can be closed to shut off the water flowing into the solenoid valve 2, so that the solenoid valve 2 will not withstand pressure, thereby increasing the safety and durability of the product.

Figure 2:
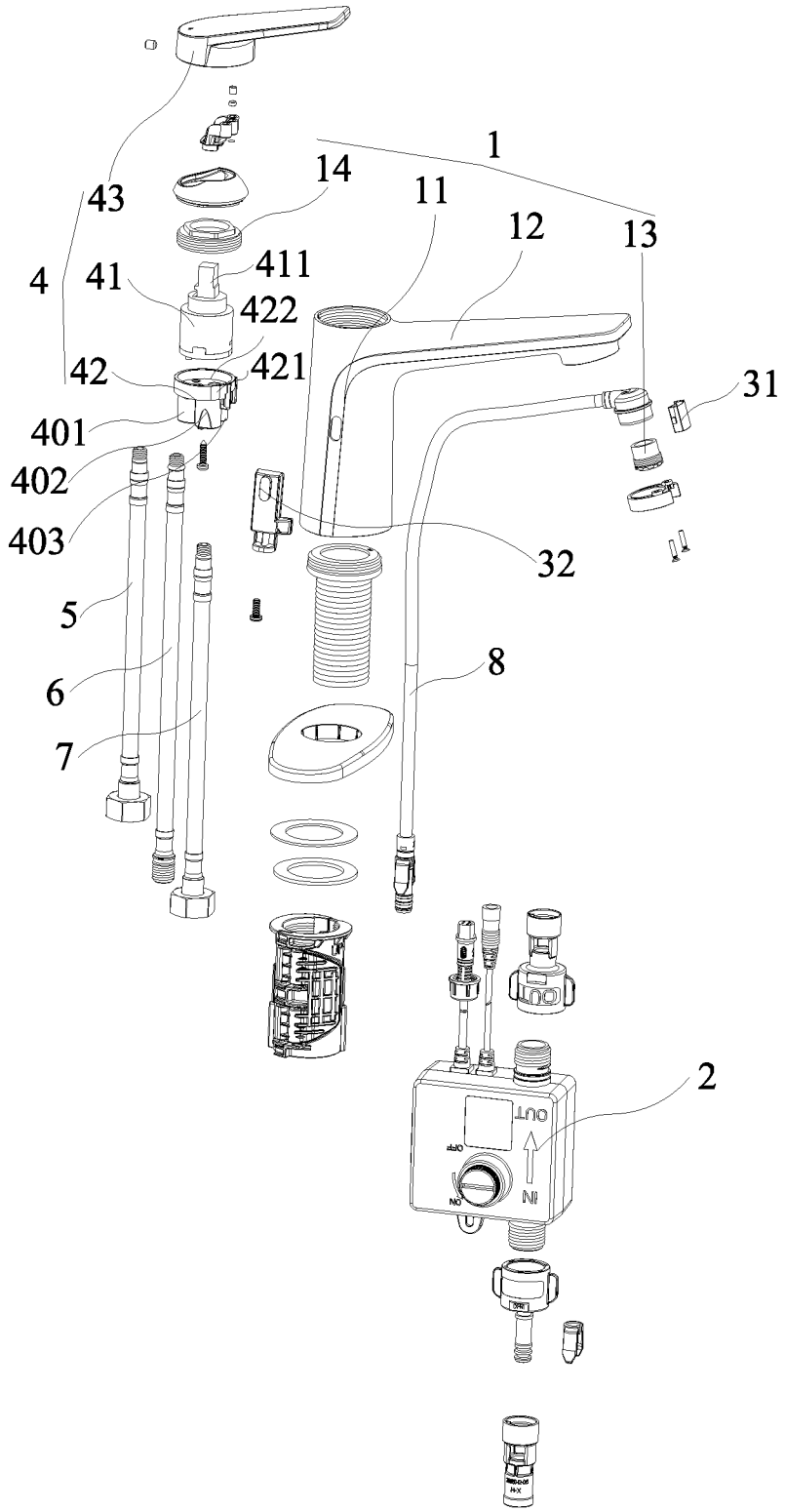
FIG. 2 is an exploded view according to the first embodiment of the present invention.
Figure 3:
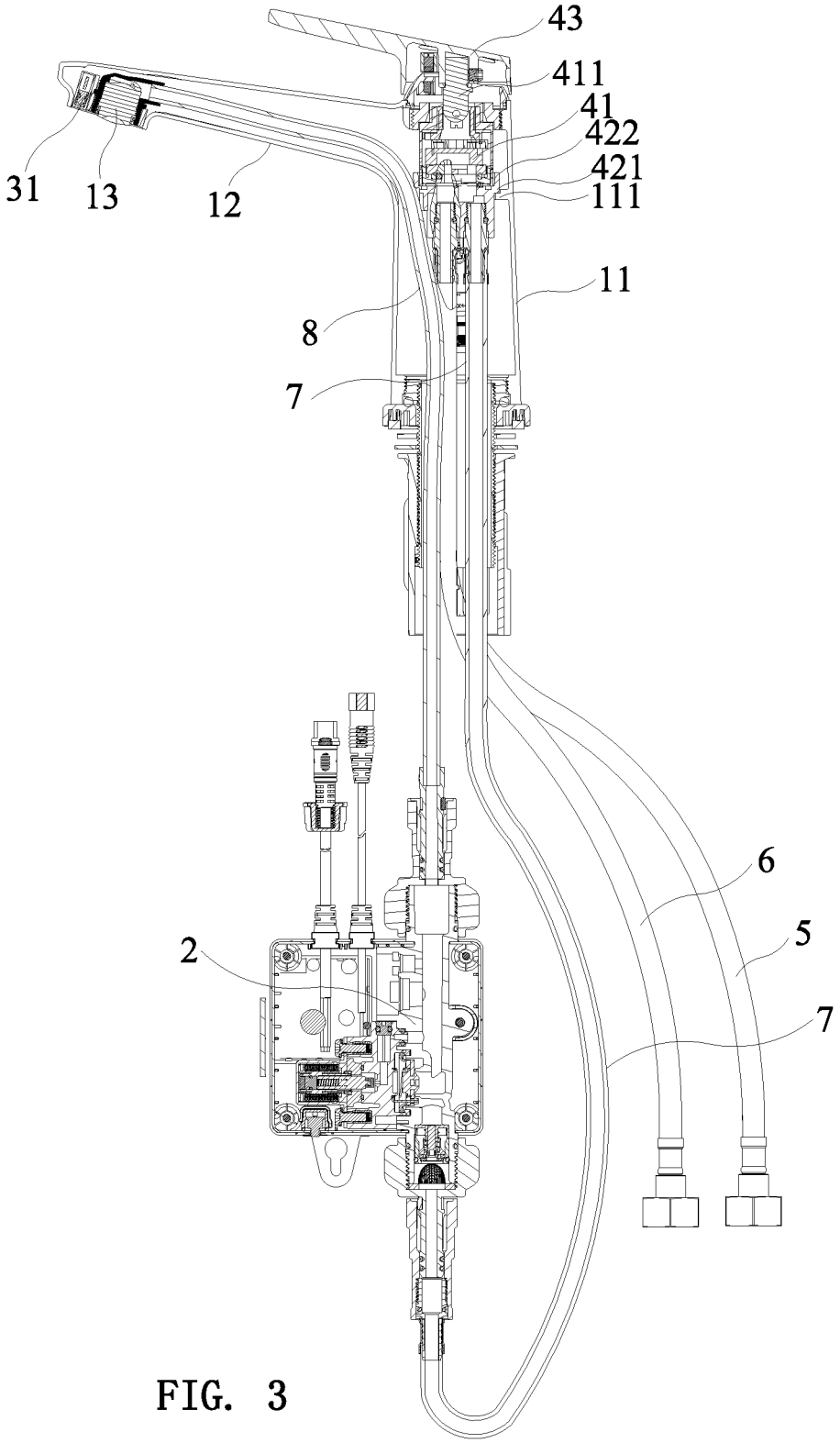
FIG. 3 is a sectional view according to the first embodiment of the present invention.

As shown in FIG. 2 and FIG. 3, the water mixing valve 4 includes a water mixing valve core 41 and a water mixing valve seat 42. The water mixing valve core 41 and the water mixing valve seat 42 are sequentially installed in the main body 11. The water mixing valve seat 42 has the cold water inlet 401, the hot water inlet 402, and the water mixing outlet 403. The water mixing valve core 41 controls the cold water inlet 401 and the hot water inlet 402 to communicate with the water mixing outlet 403, thereby adjusting the temperature of the water flowing into the solenoid valve 2. A lever 411 of the water mixing valve core 41 is connected to an operating handle 43 for operating the water mixing valve core 41.

As shown in FIG. 3, the inner wall of the main body 11 has a projecting rim 111. The outer wall of the water mixing valve seat 42 has a valve seat rim 421 abutting against the upper side of the projecting rim 111. The mixing valve core 41 is placed on top of the mixing valve seat 42. An upper opening of the main body 11 is fitted with a valve cover 14. The valve cover 14 is configured to press the water mixing valve core 41. In this way, the water mixing valve seat 42 and the water mixing valve core 41 are fitted in the main body 11 through the projecting rim 111 and the valve cover 14. The valve cover 14 is threadedly connected to the upper opening of the main body 11. The water mixing valve seat 42 has a valve seat opening 422 facing upward. The valve seat opening 422 is in communication with the cold water inlet 401, the hot water inlet 402 and the water mixing outlet 403. The lower end of the water mixing valve core 41 is inserted into the valve seat opening 422 for positioning the water mixing valve core 41 through the valve seat opening 422, so as to prevent displacement of the water mixing valve core 41.

As shown in FIG. 1 through FIG. 3, in the first embodiment of the present invention, the human body sensor unit 3 includes a first sensor 31. The first sensor 31 is disposed on the nozzle 13. The first sensor 31 is electrically connected to the solenoid valve 2. The first sensor 31 controls the solenoid valve 2 to be opened only when it senses the presence of a human body. In this way, the present invention can realize a first sensor control mode, that is, when the first sensor senses the presence of the human body, the faucet is immediately turned on; when the first sensor senses the absence of the human body, the faucet is immediately turned off. The sensing direction of the first sensor 31 is along the water spray direction of the nozzle 13. In this way, the first sensor 31 can continuously sense the hands of the user who is washing his/her hands, so that it is convenient for the user to wash his/her hands.

As shown in FIG. 1 through FIG. 3, in the first embodiment of the present invention, the human body sensor unit 3 further includes a second sensor 32. The second sensor 32 is disposed on one side of the main body 11, and the sensing direction of the second sensor 32 is interlaced with the setting direction of the spout 12. The second sensor 32 is electrically connected to the solenoid valve 2. The sensor 32 controls the solenoid valve 2 to turn on when it senses the presence of the human body, and the sensor 32 controls the solenoid valve 2 to turn off when it senses the presence of the human body again, thereby realizing a second sensor control mode. The sensing direction of the second sensor 32 is interlaced with the setting direction of the spout 12, which means that if the spout 12 is arranged on the front of the main body 11, the sensing direction of the second sensor 32 is toward the left or right of the main body 11.

Figure 4:
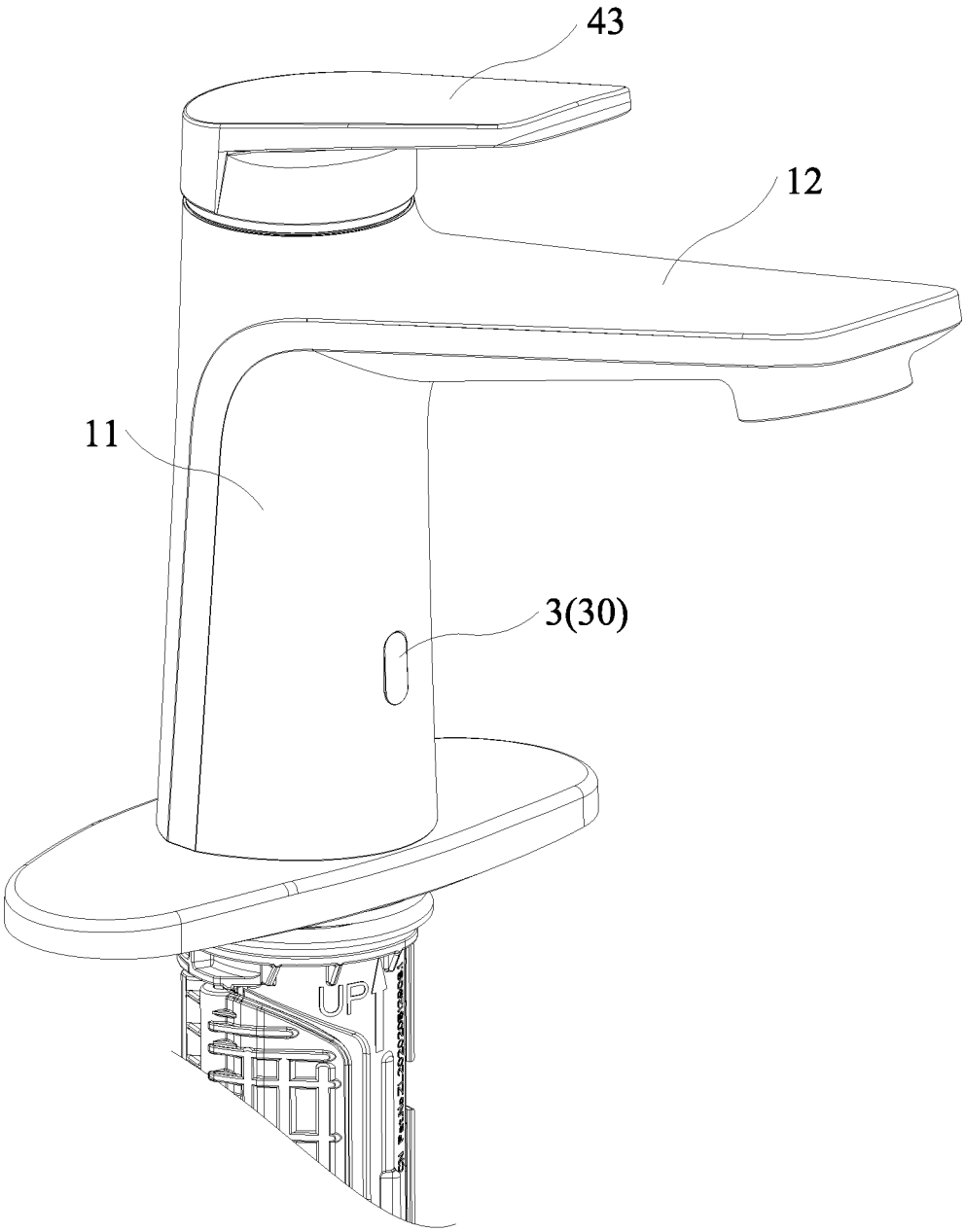
FIG. 4 is a partial perspective view according to a second embodiment of the present invention.

As shown in FIG. 4, in a second embodiment of the present invention, the human body sensor unit 3 includes a sensor 30. The sensor 30 is disposed on one side of the main body 11, and the sensing direction of the sensor 30 is in the same direction as the setting direction of the spout 12. The sensor 30 is electrically connected to the solenoid valve 2. The sensor 30 can realize different sensor control modes by sensing the different distances of the human body. Specifically, the control method of the sensor 30 may refer to the control method disclosed in Chinese Patent No. CN113464703A. The sensing direction of the sensor 30 is in the same direction as the setting direction of the spout 12, which means that if the spout 12 is arranged on the front of the main body 11, the sensing direction of the sensor 30 is toward the front of the main body 11.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A thermostatic automatic faucet, comprising a faucet body, a solenoid valve, a human body sensor unit, and a water mixing valve;

the faucet body including a main body, a spout connected to a side wall of the main body and a nozzle disposed on the spout, the main body being in communication with the spout, the nozzle being located on an underside of the spout;

the water mixing valve being installed in the faucet body, the water mixing valve having a cold water inlet, a hot water inlet and a water mixing outlet;

an inlet end of the solenoid valve being in communication with the water mixing outlet of the water mixing valve through a water mixing pipe, an outlet end of the solenoid valve being in communication with the nozzle through a delivery pipe, the water mixing pipe and the delivery pipe being inserted in the main body, the delivery pipe being further inserted in the spout and connected to the nozzle;

the human body sensor unit being fitted to the faucet body, the human body sensor unit being electrically connected to the solenoid valve and controlling the solenoid valve to be opened and closed;

wherein the water mixing valve includes a water mixing valve core and a water mixing valve seat; the water mixing valve core and the water mixing valve seat are sequentially installed in the main body, the water mixing valve seat has the cold water inlet, the hot water inlet and the water mixing outlet, and the water mixing valve core controls the cold water inlet and the hot water inlet to communicate with the water mixing outlet;

wherein an inner wall of the main body has a projecting rim; an outer wall of the water mixing valve seat has a valve seat rim abutting against an upper side of the projecting rim, the mixing valve core is placed on top of the mixing valve seat; an upper opening of the main body is fitted with a valve cover, and the valve cover is configured to press the water mixing valve core; and wherein the water mixing valve seat has a valve seat opening facing upward, the valve seat opening is in communication with the cold water inlet, the hot water inlet and the water mixing outlet; and a lower end of the water mixing valve core is inserted into the valve seat opening.

2. The thermostatic automatic faucet as claimed in claim 1, wherein a lever of the water mixing valve core is connected to an operating handle.

3. The thermostatic automatic faucet as claimed in claim 1, wherein the human body sensor unit includes a first sensor, the first sensor is disposed on the nozzle, and the first sensor is electrically connected to the solenoid valve.

4. The thermostatic automatic faucet as claimed in claim 3, wherein a sensing direction of the first sensor is along a water spray direction of the nozzle.

5. The thermostatic automatic faucet as claimed in claim 3, wherein the human body sensor unit further includes a second sensor, the second sensor is disposed on one side of the main body, a sensing direction of the second sensor is interlaced with a setting direction of the spout, and the second sensor is electrically connected to the solenoid valve.

6. The thermostatic automatic faucet as claimed in claim 1, wherein the human body sensor unit includes a sensor, the sensor is disposed on one side of the main body, a sensing direction of the sensor is in the same direction as a setting direction of the spout, and the sensor is electrically connected to the solenoid valve.

7. The thermostatic automatic faucet as claimed in claim 1, wherein a cold water pipe and a hot water pipe are connected to the cold water inlet and the hot water inlet, respectively.

* * * * *